US005555701A

United States Patent [19]

Fehringer et al.

[11] Patent Number: 5,555,701

[45] Date of Patent: Sep. 17, 1996

[54] ENVELOPE WETTING AND SEALING APPARATUS

[76] Inventors: Robert Fehringer, 3395 Rio Vista, Camino, Calif. 95709; William L. Hines, 5825 Walnut Ave., Sacramento, Calif. 95841; Motaz Qutub, 11044 Cobblestone Dr., Rancho Cordova, Calif. 95670; Jonathan D. Emigh, 7050 Mt. Aukum Rd., Somerset, Calif. 95684; Charles E. Preston, 9445 Central Ave., Orangevale, Calif. 95662; Robert Leitner; David Smart, both of 1371 Jonas Ave., Sacramento, Calif. 95825

[21] Appl. No.: 346,514

[22] Filed: Nov. 29, 1994

[51] Int. Cl.[6] ..... B65B 7/02; B65B 51/02; B65B 57/12

[52] U.S. Cl. ..... 53/75; 53/284.3; 53/377.4

[58] Field of Search ..... 53/460, 480, 491, 53/377.4, 377.6, 378.3, 383.1, 387.1, 284.3, 75, 76

[56] References Cited

U.S. PATENT DOCUMENTS

| | | | |
|---|---|---|---|
| 2,114,814 | 4/1938 | Rosebush . | |
| 3,550,351 | 12/1970 | Gombault . | |
| 3,911,862 | 11/1975 | Lupkas . | |
| 4,205,504 | 6/1980 | Gregoire et al. . | |
| 4,256,526 | 3/1981 | McDaniel | 53/383.1 X |
| 4,525,986 | 7/1985 | Noll | 53/284.3 X |
| 4,571,925 | 2/1986 | Adams | 53/284.3 X |
| 4,798,040 | 1/1989 | Haas et al. . | |
| 4,817,368 | 4/1989 | DePasquale et al. | 53/460 |
| 4,922,689 | 5/1990 | Haas et al. | 53/284.3 X |
| 4,924,804 | 5/1990 | O'Dea et al. | 53/383.1 X |
| 4,939,887 | 7/1990 | Haas et al. | 53/460 |
| 5,005,337 | 4/1991 | Kluth . | |
| 5,042,223 | 8/1991 | Gerbaud . | |

FOREIGN PATENT DOCUMENTS

| | | | |
|---|---|---|---|
| 5-97104(A) | 4/1993 | Japan | 53/377.4 |

*Primary Examiner*—Horace M. Culver
*Attorney, Agent, or Firm*—James M. Ritchey

[57] ABSTRACT

For use with an envelope having a flap, a body, and a fold region connecting the flap to the body, a wetting and sealing apparatus for wetting the envelope flap with a liquid and sealing, after folding at the fold region, the wetted envelope flap to the envelope body. A computer directs the wetting and sealing operations. A continually primed spraying nozzle applies the liquid producing an active adhesive to the envelope flap and a pressure foot seals the wetted envelope flap to the envelope body.

7 Claims, 7 Drawing Sheets

ENVELOPE WETTING AND SEALING APPARATUS

BACKGROUND OF THE INVENTION

1. Field of the Invention

Disclosed is an automated apparatus for spray wetting a glue covered region on an envelope flap and sealing the wetted envelope flap to an associated envelope. More specifically, a dynamically controlled wetting and sealing system having a spraying module, a sealing unit, and control means is related.

2. Description of the Background Art

Various examples of envelope processing equipment include relatively rudimentary means for sealing the envelopes that are processed. Often a type of wet sponge or wet brush is contacted with a flap gluing strip on the envelope.

Specifically, commonly assigned and divisional U.S. Pat. Nos. 4,798,040 and 4,922,689 disclose an insertion machine containing an envelope sealing station. The sealing station comprises a pair of sprayers with each having a liquid line and an electrical line. An envelope presence detector signals to activate the sprayers to wet an incoming envelope as it passes.

U.S. Pat. No. 3,911,862 relates an envelope flap moistening apparatus. Comprising the device is a set of spray nozzles that are adjustable via associated solenoids that alter the vertical positions of the nozzles. Envelope and flap detection means are included and comprise light emitting diodes and photoelectric detectors.

Provided in U.S. Pat. No. 2,114,814 is a stuffing and sealing machine. A bottle supplies water to wet the envelope glue strip. A throw member serves to press the wetted flap against the envelope for sealing.

A device for transforming envelopes and the like is presented in U.S. Pat. No. 3,550,351. Brushes wick fluid from a water tray and apply it to the envelope flap. Rollers seal the wetted envelope.

U.S. Pat. No. 4,205,504 describes a method and device for making envelopes from a continuous web and includes the stuffing and sealing of those envelopes. Specifically, glue strips are provided in appropriate locations to adhere to one another during the assembly process.

An envelope mailer is supplied in U.S. Pat. No. 5,005,337. A gluing station is present that applies glue via rollers. Sealing is by a series of subsequent rollers.

U.S. Pat. No. 5,042,223 discloses an article positioning control apparatus including an envelope flap moistening station having a water tank.

The usefulness of the prior art wetting-sealing devices is limited by such practical considerations as awkward multiple spray nozzles, efficient or effective wetting that occurs only when the envelopes travel at a set velocity, wetting means that require time to recover activity when the passing envelopes are halted, wetting and sealing envelopes for which an error has occurred in which the erred envelope should not be wetted and sealed, and the requirement of an envelope location sensor to determine if an envelope is ready to be wetted. By means of an overseeing computer controller and strategically designed wetting and sealing means, the subject system provides an integrated sealing scheme that dynamically merges a spray wetting module with a sealing unit to overcome the limitations presented in the existing wetting-sealing devices. Further, since the subject system utilizes a shaft encoder coupled to the associated inserter machine and a controller that tracks when envelopes enter the inserter, no envelope location sensor is required in the subject invention, unlike the existing devices currently employed in the industry.

SUMMARY OF THE INVENTION

An object of the present invention is to disclose an envelope wetting and sealing apparatus having an integrated computer control for directing the wetting and sealing process.

Another object of the present invention is to provide an envelope wetting and sealing apparatus that upon detecting an error in the assembly of the envelope does not wet the envelope for sealing.

A further object of the present invention is to supply an envelope wetting and sealing apparatus having a wetting means that is constantly primed to facilitate rapid wetting of envelopes, even after the apparatus is stopped.

Still another object of the present invention is to furnish an envelope wetting and sealing apparatus having a sequence of spray bursts for each enveloped wetted, thereby permitting the wetted envelopes to be moved beneath the wetting means at variable speeds and still be wetted in a satisfactory manner.

Yet a further object of the present invention is to describe an envelope wetting and sealing apparatus that requires no envelope positioning sensor, other that a shaft encoder, coupled to the subject controller, that registers overall functioning of an associated inserter mechanism that transports the envelopes through the subject invention.

Disclosed for utilization with an envelope having a flap, a body, and a fold region connecting the flap to the body, is a wetting and sealing apparatus. The subject apparatus is for wetting the envelope flap with a liquid and sealing, after folding at the fold region, the wetted envelope flap to the envelope body. Comprising the subject invention is a controller means for monitoring envelope processing, including detecting any envelope processing errors and for directing the wetting and sealing operations. Wetting means for applying the liquid, usually water, producing an active adhesive to the envelope flap is included. Usually, provided are means for folding the wetted envelope flap at the folding region. Additionally, means for sealing the folded and wetted envelope flap to the envelope body is encompassed. Further, supplied is a means for folding the envelope flap against the envelope body.

More specifically, the controller means generally comprises a computer programmed to activate the wetting means only when no envelope processing error is detected by the computer. The computer is also programmed to activate the sealing means at appropriate times, usually with or without the envelope having a wetted flap.

Included in a preferred embodiment of the subject invention are means for maintaining the wetting means in a primed state. The wetting means usually comprises an air actuated nozzle that sprays the envelope flap with water via a plurality of spray bursts. Each of the spray bursts is for a computer initiated first period of time. Generally, the primed state maintaining means comprises releasing a burst of spray from the nozzle for a computer initiated second period of time if the envelope has not moved in a computer determined third period of time. A collection means is included to gather excess moisture during the wetting and priming events.

The sealing means comprises a pressure foot that presses or "stomps" the wetted envelope flap against the envelope body. The computer directs and coordinates the application of the pressure foot.

Other objects, advantages, and novel features of the present invention will become apparent from the detailed description that follows, when considered in conjunction with the associated drawings.

DESCRIPTION OF THE PREFERRED EMBODIMENT

Figure 1:
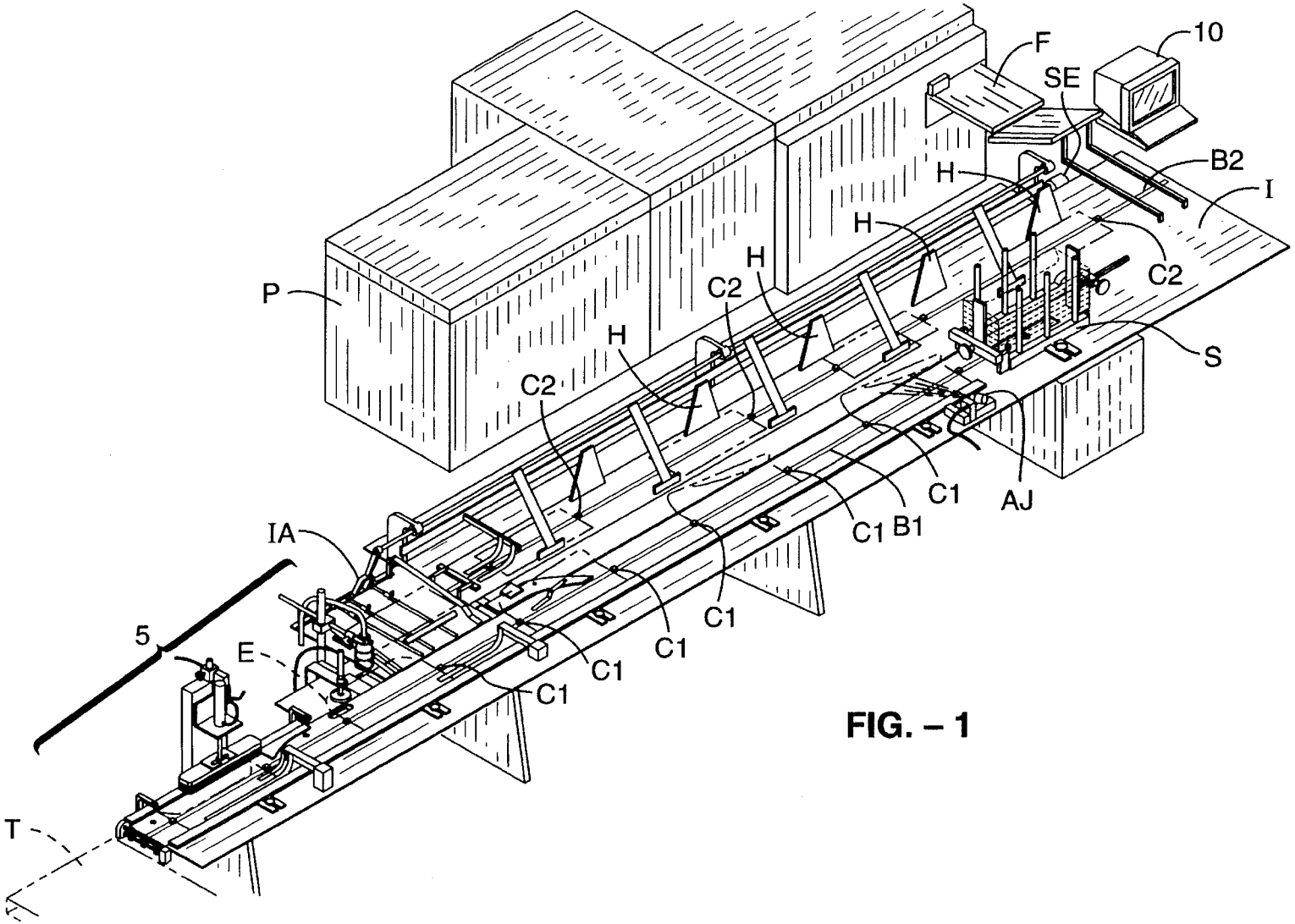
FIG. 1 is a perspective view of the subject invention illustrating use on a typical envelope processing or assembly system having a printer, folder, and inserter.

Referring now to FIGS. 1–8, there is shown a preferred embodiment of a wetting and sealing units 5 and the controller or computer 10 of the subject invention. Generally, the subject apparatus is utilized in connection with an envelope assembly system that assembles mailing pieces for bulk mailing operations. An assembled mailing piece often comprises an outer mailing envelope, internal forms or folded pages (such as detailed and summary billing statements), inserts (such as advertisements, notices, and the like), a return envelope, and similar items. Each mailing envelope is of a traditional or standard configuration having a flap with an area for adhesive, a body, and a fold region connecting the flap to the body. Usually, the envelope or mailing piece assembly system comprises a forms or pages source such as a printer, means for folding or a transport assembly for transferring the forms or pages to subsequent equipment F, a traditional envelope inserter machine I that places various hopper H held inserts into a mailing envelope E, and a transport T apparatus for subsequent processing of the stuffed and sealed envelopes (in particular, see FIG. 1 ). The subject envelope wetting means and sealing means 5 are positioned at the end of the inserter I, between the point on the inserter I at which the inserts are actually inserted into the envelope by the insertion means (usually inserter arms IA) and the subsequent transport T apparatus.

Usually, a typical mailing piece comprising a bill from a product or service provider is assembled as follows: 1) detailed and summary statement sheets are printed in the high speed printer P; 2) the statement sheets are folded by suitable means F and transferred to the inserter machine I and collected in with the subsequent inserts; 3) from a mailing envelope source S, mailing envelopes E have their flaps opened by an air jet and associated components AJ and are moved across the upper surface of the inserter by appropriate means such as a first chain or belt B1 system with claws C1 for catching each envelope E; 4) single or multiple inserts are supplied via the various hoppers H and associated mechanisms and delivered by a second chain or belt B2 system with claws C2 to the actual insertion means or insertion arms IA; 5) to avoid hitting the envelope flaps, each envelope E flap is deflected downwardly and enters a lower region via an entrance EN (see FIG. 6 for details) and the insertion arms IA slide each insert packet (inserts and statements) into each mailing envelope E; 6) each stuffed envelope is moved to the subject wetting means and the flap emerges from below the upper surface of the inserter I via an exit EX (again, see FIG. 6 for details) and is once again exposed and wetted (an encoding device ED is often included for dating or marking each envelope after it is wetted); 7) the wetted envelope moves past a subject flap folding means that folds the flap against the body of the envelope; 8) each envelope it "stomped" or pressed by the subject sealing means to seal wetted flaps to the envelope; and 9) the assembled mailing piece is placed in a transport T apparatus for subsequent processing. It must be noted that even though the above scheme is a common assembly pathway, more complex assembly pathways are contemplated and will be discussed in more detail below and include detection of errors in a mailing piece and stopping the assembly process for whatever reason.

More specifically, the subject invention comprises a wetting and sealing apparatus having a controller means for overseeing the assembly operation. Although the controller means may be any now known or later developed hardwired or equivalent means, preferably, the controller means is a computer 10 programmed to monitor and direct the assembly of each mailing piece according to appropriate data base and equivalent information. The computer 10 is normally used by an operator and is a stand alone unit or linked directly or indirectly to additional hardware and software, or the equivalent, having additional information and controlling routines. The computer 10 monitors and directs, usually in cooperation with the operator, the various phases of the assembly process.

Since the computer 10 oversees the assembly process, the location of each item comprising the mailing piece is carefully tracked. The computer is configured and equipped with appropriate input devices to detect various errors such as mismatched forms, inserts, envelopes, and the like. Such error detection devices include readers (bar code readers and the like) that scan for indicia encoded forms, envelopes, inserts, and the like to verify that correct items are within each mailing piece. When errors are encountered by the computer the assembly process can be halted or allowed to proceed, depending upon an operator's election or standard protocol. Typically, should a faulty mailing piece be detected the computer has the option of stopping the process or simply not wetting the incorrectly assembled piece, thereby producing a non-sealed mailing piece that can be checked by the operator. Usually, when no envelope processing error is detected by the computer the subject wetting means is activated.

The subject computer establishes the locations for the various mailing pieces and items to go within mailing pieces by tracking encoded indicia at known positions in the apparatus and by utilizing the machine cycle of the typical inserter I. A typical inserter I includes a central rotating timing and drive shaft that operates the insert hoppers H, insertion means IA, drive chains C1 and C2, mailing envelope opener AJ, and the like. A standard shaft encoder SE is coupled to the inserter's central timing shaft and utilized to fix the position of any item on the inserter I. Combining the established locations for the error detection scanners with the information derived from the shaft encoder allows the computer to know when each correctly assembled mailing piece needs to have its mailing envelope flap sprayed with a wetting liquid. Should an incorrectly assembled mailing piece reach the subject wetting means, the computer merely directs that no wetting occur for that piece. Since a mailing piece that is not wetted will not seal, to simplify the sealing process, all of the mailing pieces passing through the sealing means can be acted upon (pressured clamped) and only the correctly assembled ones will seal. Although not preferred, it is noted that the sealer means may be turned off for any non-wetted mailing piece.

Further comprising the subject invention is the wetting means. The subject means for wetting an envelope flap is shown in FIGS. 1, 2, 3, and 6. After the correct inserts, forms, and the like are inserted into the mailing envelope E by the associated inserter I, the mailing envelope is ready to be sealed. However, should the controller detect that an incorrectly assembled mailing piece is present the wetting means is usually not activated, thereby producing a non-sealable (not wetted) envelope that can easily be opened and corrected by the operator.

Most envelopes wetted by the subject system have on the underside of the flap (underside after sealing against the body of the envelope) a pre-applied adhesive or gluing material. Although the liquid applied to the flap of the envelope is generally and preferably water of a like solution that wets and activates the pre-applied adhesive or glue material, the adhesive itself could be delivered by the subject wetting system. The mainly water liquid may have additional substances to aid in the wetting process.

Figures 2, 3:
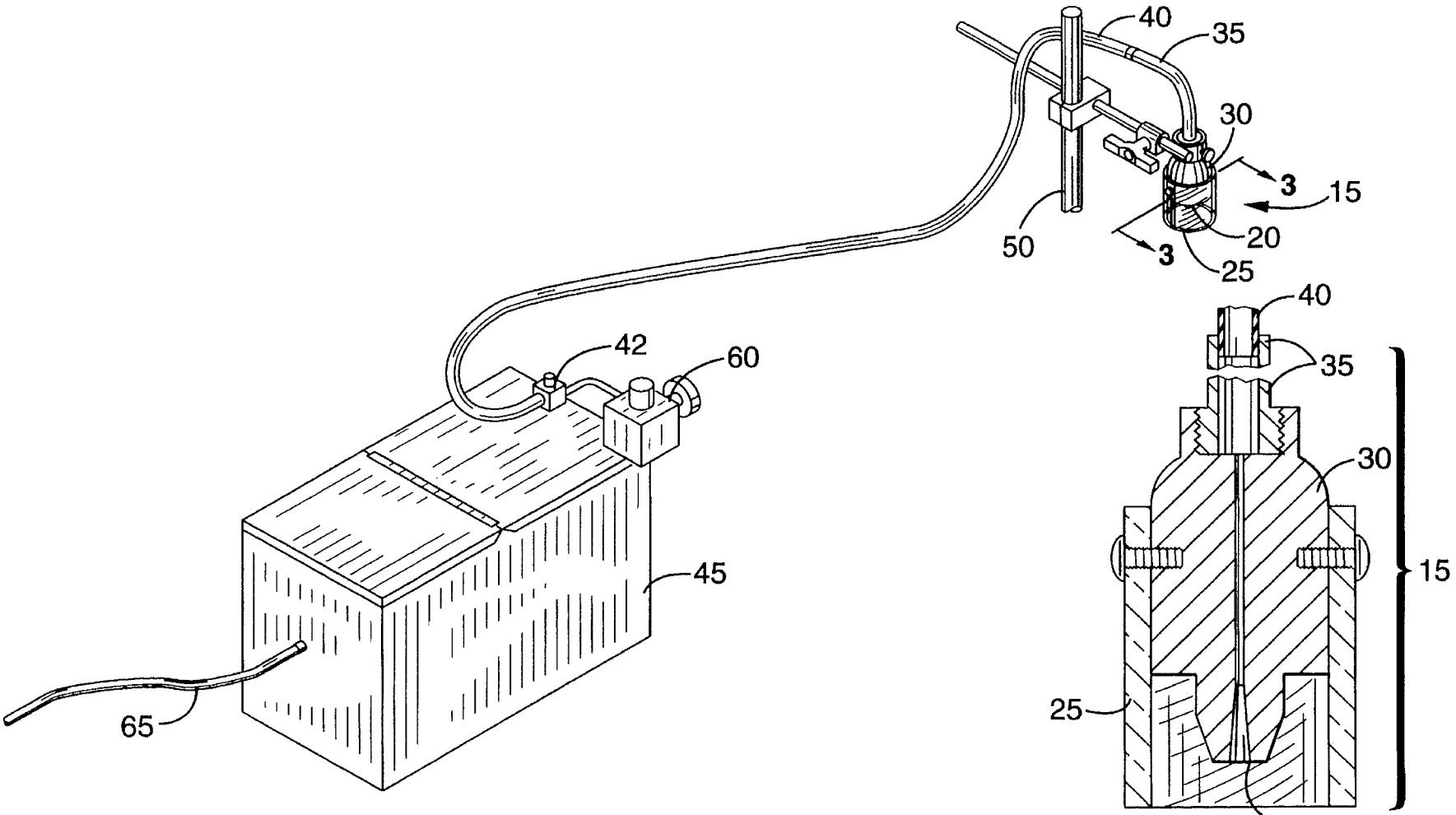
FIG. 2 is a perspective view of the spray unit of the subject invention.
FIG. 3 is a perspective view of the spray head of the subject invention.
Figure 6:
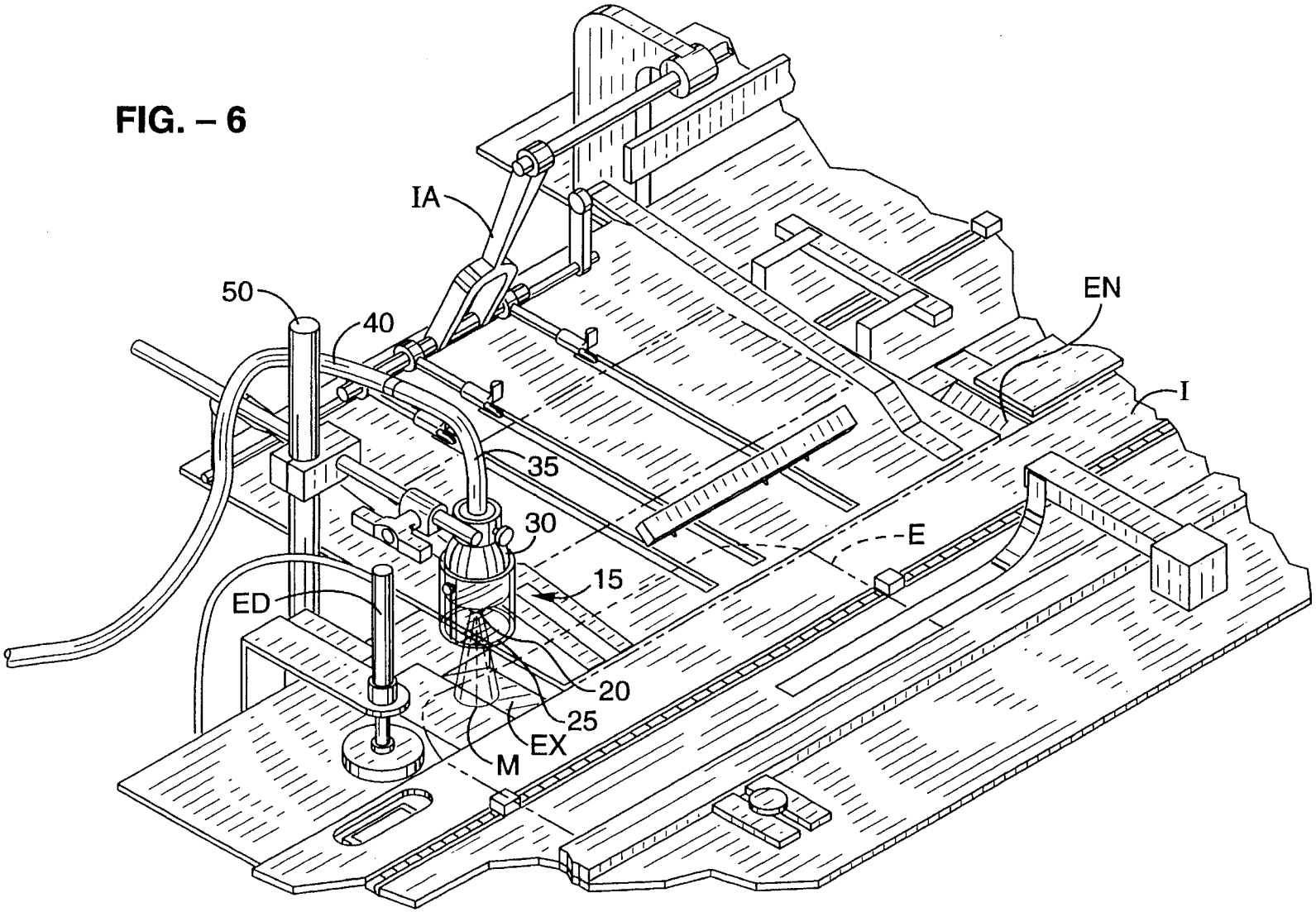
FIG. 6 is a perspective view of the wetting means of the subject invention associated with an inserter apparatus.

Referring in particular to FIGS. 2,3, and 6, comprising the preferred wetting means is a spraying head 15 (enlarged in FIG. 3) having a nozzle 20 and mist collecting hood 25 secured to a mounting member 30. Feeding the nozzle 20 with liquid is a spray arm member 35 that leads via a hose 40 and coupler 42 to the liquid reservoir 45. A brace member 50 anchors the spraying head 15 to the associated inserter I.

Since the spraying head nozzle 20 is preferably an air actuated system, the liquid reservoir 45 also includes an air source with necessary pressure gauges 60. The hose 40 is usually a coaxial structure having an inner water tube and an outer air passageway. The water is drawn out of the inner feeder tube by the pressurized air escaping through the spray nozzle 20 in a type of Venturi phenomenon. The escaping air causes the exiting liquid to atomized into a mist M (see FIG. 6 for indication of mist M) which is directed onto the flap.

The air driven type of liquid spray delivery system is easily activated by the subject controller which is connected via appropriate means 65. Usually the spray head 15 is turned on by the controller for a set period of time. The duration of the spray burst may be varied as needed. Generally, the controller activates the spraying head 15 for a series of spray bursts. The advantage of utilizing a plurality of spray bursts is that the speed of the passing envelope can vary yet sufficient wetting of the flap occurs. For example, if the envelope is moving at a rapid velocity, the flap is wetted by perhaps the middle or last bursts in a series of spray bursts. If the envelope is moving at a slow velocity, the flap is wetted by perhaps the initial or middle bursts in a series of spray bursts. The exact number of spray bursts can vary between one and ten or greater, however, between three and five is more usual and preferably four spray bursts has been found acceptable in most instances. Each spray burst is usually for approximately the same span of time, but variable time periods are contemplated.

Because the envelopes can travel at relatively high speeds or velocities and can move from the stuffing position on the inserter I to the wetting means in a short interval of time, the wetting means is equipped with a priming mechanism to keep the spray head 15 in a primed condition or state between envelopes E and ready to immediately deliver a spray after either a short or prolonged delay. When the associated inserter I pauses, the liquid in the feeder tube tends to drain back into the reservoir 45, thereby requiring a finite amount of time for the expended air to bring the liquid back to the tip on the nozzle 20 for wetting. The delay in delivering liquid to the nozzle 20 tip could result in non-wetted and thus non-sealed envelopes. To overcome this difficulty, the priming scheme was developed. The controller is programmed to keep the spraying head 15 primed by initiating a timed pulse or burst of mist after a determined period of time, even when no envelopes are beneath the spraying head 15. For convenience and neatness, the priming mist M or excess wetting mist M is conveyed into a liquid waste container via the envelope exit EX and is transported away from the envelope pathway.

Figure 4:
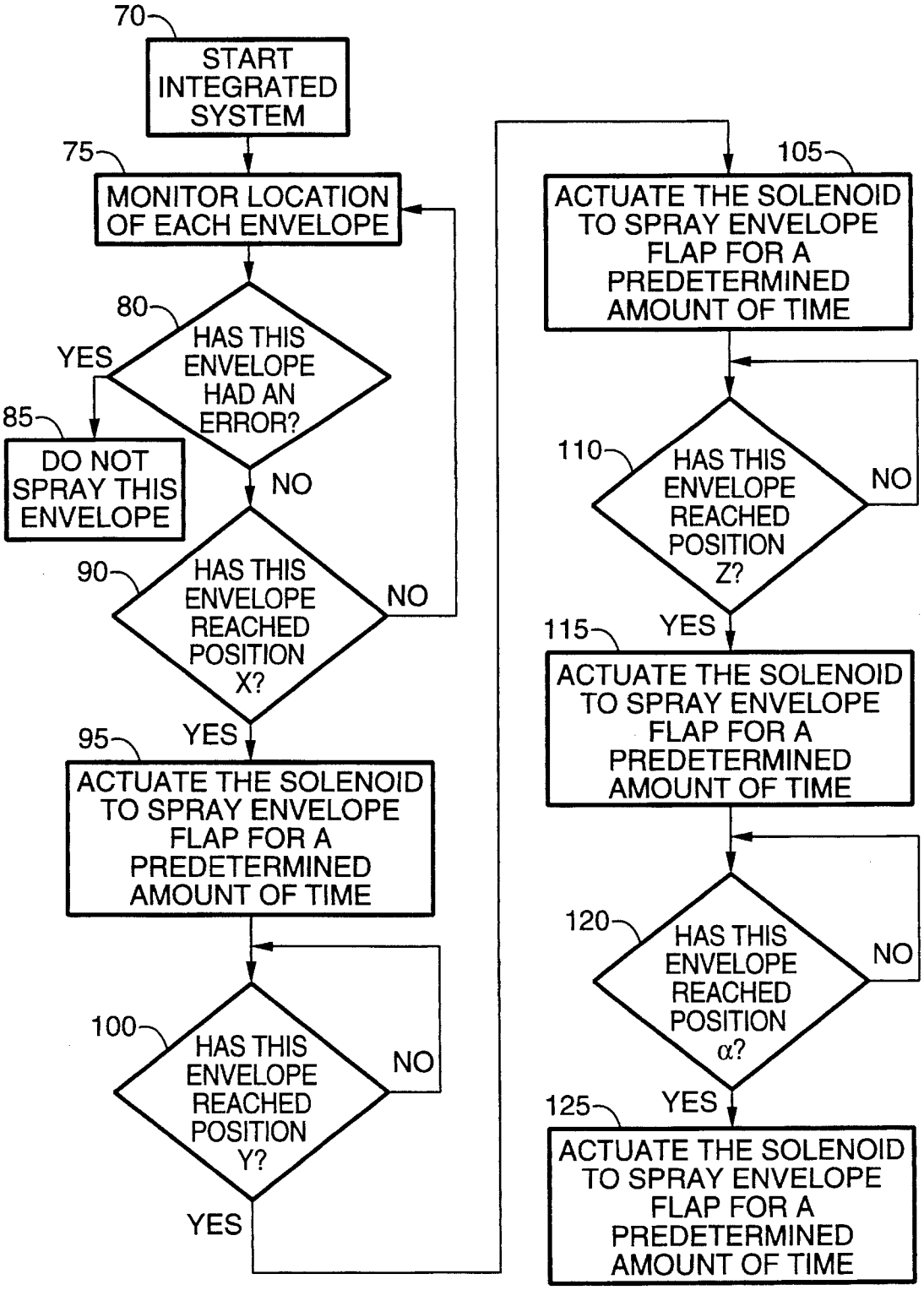
FIG. 4 is a flow diagram of the information controlling the spray unit of the subject invention.

Shown in FIG. 4 is a typical flow diagram for the information that controls the spray bursts to wet an envelope flap. Although four spray bursts are depicted in FIG. 4, this number, as noted above, can vary between one and greater values and this and other variations on the control scheme are contemplated to be within the realm of this disclosure, as applied by one skilled in the relevant art. As described above, the positional timing and placement for the envelopes traveling through the inserter I come from noting the rotation of the central timing shaft in the inserter I via a shaft encoder scheme.

The controller or computer 10 is programmed to start the integrated wetting and sealing system 70, in particular here the wetting portion is focused in on. The computer means 10 monitors the location of each mailing envelope 75. It is determined if an error has been detected in the processing of the contents of the mailing envelope 80 and if so that envelope is not wetted 85. If no processing error is detected by the computer 10, the computer 10 establishes if the envelope has reached a rotational position "X" 90 (corresponding to a first position of the flap beneath the spraying head 15). If no is the answer to step 90, the system loops back to step 75 until satisfied and then proceeds to step 95. At step 95 the solenoid valve 42 controlling the release of spray is activated to cause the first burst of spray.

The computer 10 then verifies in step 100 that a second rotational position "Y" has been reached. If the "Y" position has not been achieved, the step loops until it has been noted and proceeds to step 105 in which a second burst of spray is actuated. The computer 10 then verifies in step 110 that a third rotational position "Z" has been reached. If the "Z" position has not been achieved, the step loops until it has been noted and proceeds to step 115 in which a third burst of spray is actuated. The computer 10 then verifies in step 120 that a fourth rotational position "α" has been reached. If the "α" position has not been achieved, the step loops until it has been noted and proceeds to step 125 in which a fourth, or last in this embodiment, burst of spray is actuated. The wetted envelope E then leaves the wetting area.

Figure 7:
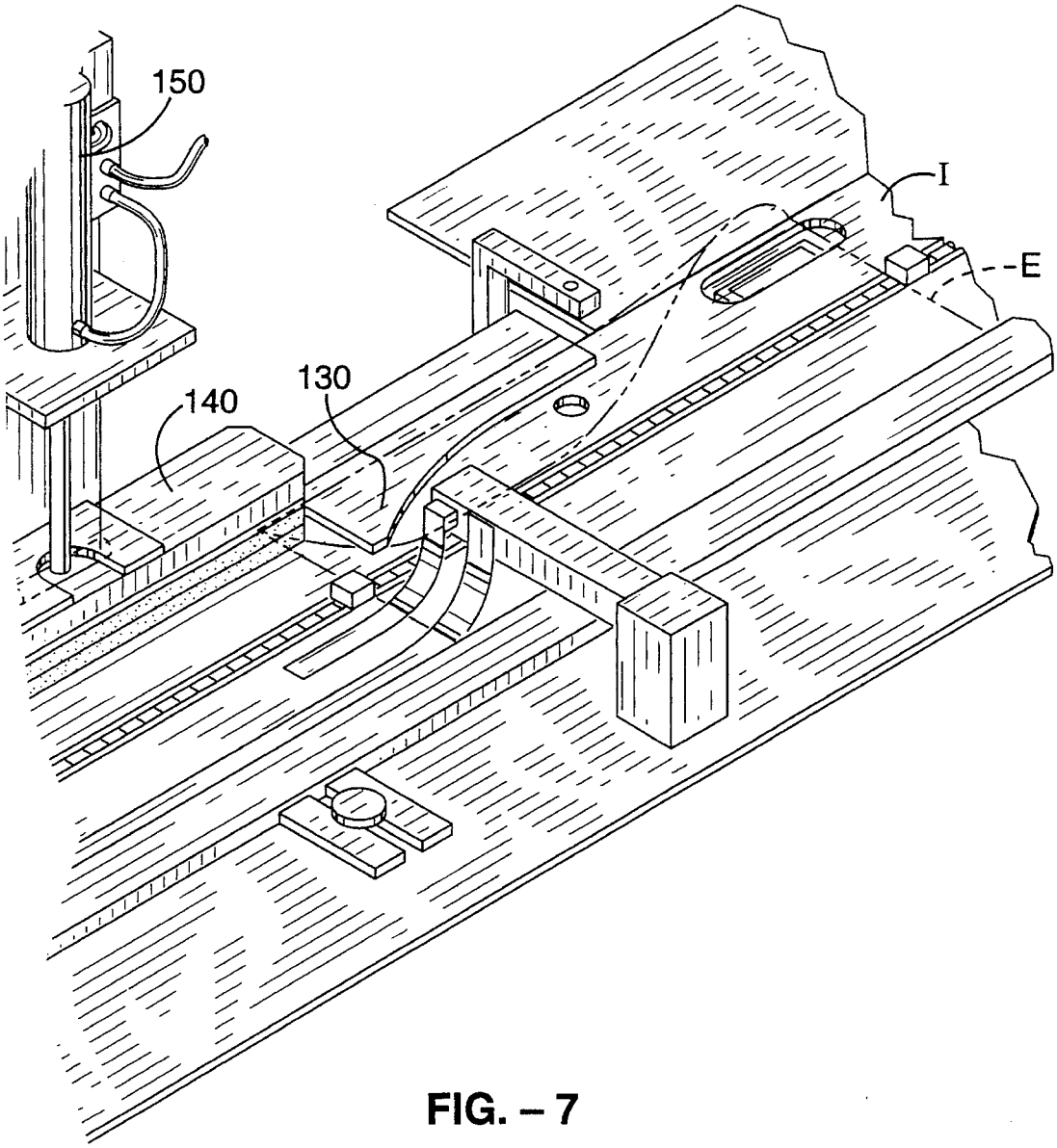
FIG. 7 is a perspective view of the flap folding means and a portion of the sealing means (for orientation purposes) of the subject invention associated with an inserter apparatus.

As seen in FIG. 7, included in the subject invention is the flap folding means comprising a contoured blade 130 that forces the wetted (or if an error is detected, a non-wetted)

flap to fold along the fold region. The folding blade has a shaped lower surface that initiates and prompts the flap to fold over against the body of the envelope.

Figure 8:
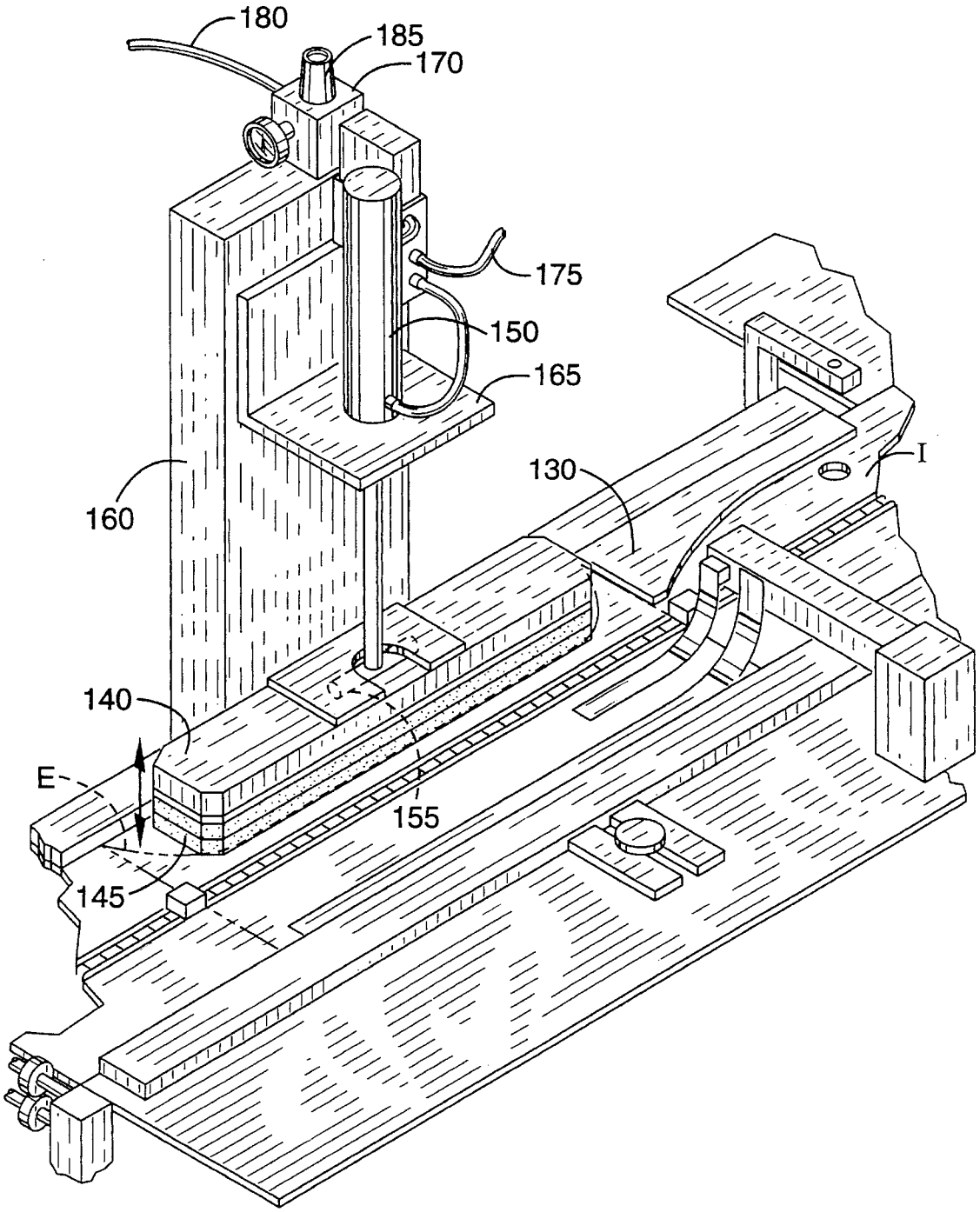
FIG. 8 is a perspective view of the sealer means of the subject invention associated with an inserter apparatus.

Additionally comprising the subject invention is the sealing means shown generally in FIG. 1 and in detail in FIG. 8. Each envelope E entering the sealing means has its flap either wetted or not and folded against the body of the envelope by the folding means. Preferably, the action required to seal a wetted envelope is performed on every envelope that enters the sealing means, with or without wetting, however, the sealing action can be adjusted by the controller to only occur on wetted envelopes. Comprising the sealing means is a rigid pressure foot member 140 with an attached pad 145 that cushions the impact of the foot 140 against the flap. The pressure foot member 140 presses or "stomps" the folded flap against the envelope body to cause sealing of a wetted flap. After pressing the envelope, the foot 140 is raised to release the applied pressure and the sealed envelope is then transported to subsequent processing equipment T. The foot 140 and pad 145 are sized to span enough of the envelope to cause sealing to occur.

The foot 140 activated by a solenoid unit 150 driven by standard means such as pressure, vacuum, or electricity and preferably by pressure. The foot 140 is secured to the solenoid plunger 155 which causes the up and down "stomping" motion as the solenoid is directed by the controller means to release and press, respectively. The solenoid is anchored to the inserter 1 by a mounting block 160 and bracket 165. The solenoid is activated by associated a control unit 170 linked to the system controller by suitable information transmissions lines or cables 175. Usually, a pressure line 180 feeds the control unit 170 with activating pressure, via a pressure regulation means 185. As the system computer 10 directs, the solenoid plunger 155 is lowered and raised. The actual pressure exerted by the solenoid on an envelope can be adjusted.

Figure 5:
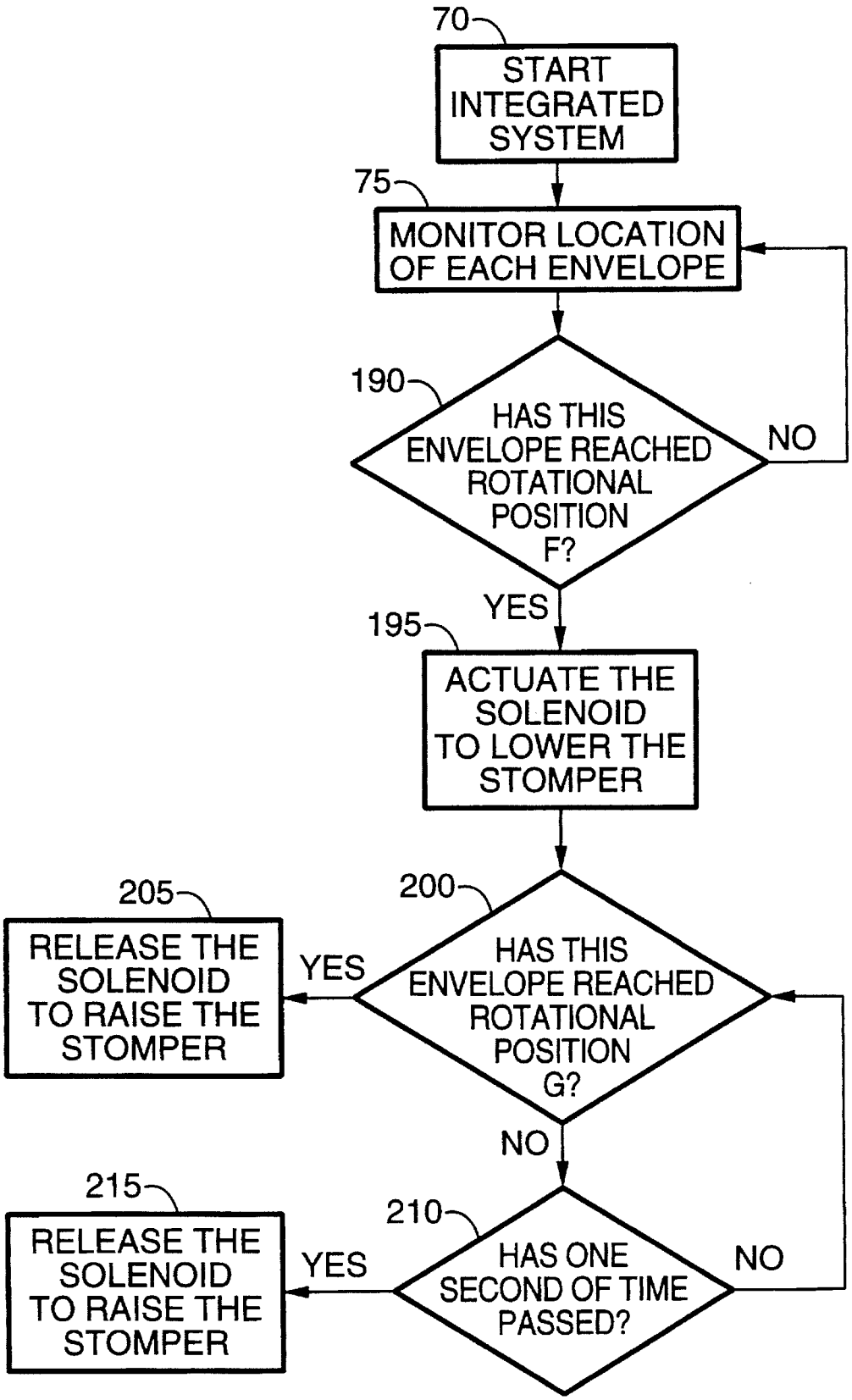
FIG. 5 a flow diagram of the information controlling the sealer unit of the subject invention.

Shown in FIG. 5 is a typical flow diagram for the information that controls the sealing means. As indicated above, the controller or computer 10 is programmed to start the integrated wetting and sealing system 70, in particular here the sealing portion is focused in on. As noted above, the computer means 10 monitors the location of each mailing envelope 75. In step 190, the computer 10 establishes if the envelope has reached an inserter I timing shaft rotational position "F" (corresponding to a position of the envelope beneath the foot 140). If no is the answer to step 190, the system loops back to step 75 until satisfied with the position of the envelope being under the foot 140. When the envelope is below the foot 140 of the sealing means, the solenoid is activated 195.

Step 200 entails determining if the envelope (or statement packet) has reached a rotational position G on the central timing shaft of the inserter I. If the rotational position G has been achieved, step 205 is the release of the solenoid to raise the foot 140. However, if the rotational position G has not been reached, step 210 queries if a set period of time has passed, usually about one second, but the time period may be lesser or greater than one second. If the time period selected in step 210 has been passed, step 215 is the release of the solenoid to raise the foot 140.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For utilization with an envelope having a flap, a body, and a fold region connecting the flap to the body, a wetting and sealing apparatus for wetting the envelope flap with a liquid and sealing, after folding at the fold region, the wetted envelope flap to the envelope body, comprising:

a) controller means for monitoring envelope processing including detecting an assembly of a mismatched mail piece and for directing the wetting and sealing operations;

b) wetting means for applying the liquid producing an active adhesive to the envelope flap of a correctly assembled mailing piece; and c) sealing means for sealing the wetted envelope flap to the envelope body of a correctly assembled mailing piece.

2. A wetting and sealing apparatus according to claim 1, wherein said sealing means comprises a reciprocating pressure foot that presses said wetted envelope flap against the envelope body and raises to release a sealed envelope.

3. For utilization with an envelope having a flap, a body, and a fold region connecting the flap to the body, a wetting and sealing apparatus for wetting the envelope flap with a liquid and sealing, after folding at the fold region, the wetted envelope flap to the envelope body, comprising:

a) controller means for monitoring envelope processing including detecting an envelope processing error and for directing the wetting and sealing operations;

b) wetting means for applying the liquid producing an active adhesive to the envelope flap, wherein said wetting means comprises an air actuated nozzle that wets the envelope flap with the liquid via a plurality of spray bursts, wherein each of said spray bursts is for a controller means initiated first period of time;

c) sealing means for sealing the wetted envelope flap to the envelope body; and d) means for maintaining said nozzle in a primed state between wetting each envelope within a plurality of envelopes, wherein said primed state maintaining means comprises releasing a burst of spray from said nozzle for a controller means initiated second period of time if the envelope has not moved in a controller means determined third period of time.

4. For utilization with an envelope having a flap, a body, and a fold region connecting the flap to the body, a wetting and sealing apparatus for wetting the envelope flap with a liquid and sealing, after folding at the fold region, the wetted envelope flap to the envelope body, comprising:

a) controller means for monitoring envelope processing including detecting an assembly of a mismatched mail piece and for directing the wetting and sealing operation;

b) wetting means for applying the liquid producing an active adhesive to the envelope flap of a correctly assembled mailing piece;

c) means for folding said wetted envelope flap at the folding region of a correctly assembled mailing piece; and d) means for sealing the folded and wetted envelope flap to the envelope body of a correctly assembled mailing piece.

5. A wetting and sealing apparatus according to claim 4, wherein said sealing means comprises a reciprocating pressure foot that presses said wetted envelope flap against the envelope body and raises to release a sealed envelope.

6. For utilization with an envelope having a flap, a body, and a fold region connecting the flap to the body, a wetting and sealing apparatus for wetting the envelope flap with a liquid and sealing, after folding at the fold region, the wetted envelope flap to the envelope body, comprising:

a) controller means for monitoring envelope processing including detecting an envelope processing error and for directing the wetting and sealing operations;

b) wetting means for applying the liquid producing an active adhesive to the envelope flap, wherein said wetting means comprises an air actuated nozzle that wets the envelope flap with the liquid via a plurality of spray bursts, wherein each of said spray bursts is for a controller means initiated first period of time;

c) means for folding said wetted envelope flap at the folding region; and d) means for sealing the folded and wetted envelope flap to the envelope body; and e) means for maintaining said nozzle in a primed state between wetting each envelope within a plurality of envelopes, wherein said primed state maintaining means comprises releasing a burst of spray from said nozzle for a controller means initiated second period of time if the envelope has not moved in a controller means determined third period of time.

7. For utilization with a plurality of envelopes with each of the envelopes having a flap, a body, and a fold region connecting the flap to the body, a wetting and sealing apparatus for wetting the envelope flap with a liquid and sealing, after folding at the fold region, the wetted envelope flap to the envelope body, comprising:

a) a computer for monitoring envelope processing including detecting an assembly of a mismatched mail piece and for directing the wetting and sealing operations;

b) wetting means for applying the liquid producing an active adhesive to the envelope flap of a correctly assembled mailing piece, wherein said wetting means comprises an air actuated nozzle that wets the envelope flap with the liquid via a plurality of spray bursts, wherein each of said spray bursts is for a controller means initiated first period of time;

c) means for maintaining said wetting means in a primed state between wetting each envelope within the plurality of envelopes, wherein said primed state maintaining means comprises releasing a burst of spray from said nozzle for a controller means initiated second period of time if the envelope has not moved in a controller means determined third period of time;

d) means for folding said wetted envelope flap at the folding region; and e) means for sealing the folded and wetted envelope flap to the envelope body of a correctly assembled mailing piece, wherein said sealing means comprises a reciprocating pressure foot that presses said wetted envelope flap against the envelope body and raises to release a sealed envelope.

* * * * *